US005269530A

United States Patent [19]

Miller

[11] Patent Number: 5,269,530

[45] Date of Patent: Dec. 14, 1993

[54] WORD-SPELLING GAME AND METHOD OF PLAYING SUCH A GAME

[76] Inventor: Tyrone W. Miller, Bland Correctional Center, Rte. 2, Box 143, Bland, Va. 24315-9615

[21] Appl. No.: 894,920

[22] Filed: Jun. 8, 1992

[51] Int. Cl.[5] ..... A63F 3/00

[52] U.S. Cl. ..... 273/243; 273/272

[58] Field of Search ..... 273/243, 246, 254, 256, 273/272; 434/129, 130, 171, 172

[56] References Cited

U.S. PATENT DOCUMENTS

| | | | |
|---|---|---|---|
| 3,759,521 | 9/1973 | Breslow et al. . | |
| 3,941,388 | 3/1976 | Isaac et al. . | |
| 3,984,106 | 10/1976 | White . | |
| 4,067,579 | 1/1978 | Boofer | 273/254 |
| 4,354,684 | 10/1982 | McKinley | 273/256 |
| 4,359,226 | 11/1982 | Neff . | |
| 4,601,473 | 7/1986 | Dulren et al. | 273/272 |
| 4,730,831 | 3/1988 | De Sio | 273/243 |
| 4,741,538 | 5/1988 | Lewis | 273/243 |
| 4,842,281 | 6/1989 | Turner | 273/256 |
| 4,893,819 | 1/1990 | Wright . | |
| 4,934,711 | 6/1990 | Runstein | 273/272 |
| 4,993,717 | 2/1991 | Fiske | 273/243 |
| 5,071,135 | 12/1991 | Campbell | 273/256 |
| 5,108,112 | 4/1992 | Gould | 273/243 X |

*Primary Examiner*—William Stoll

*Attorney, Agent, or Firm*—Stevens, Davis, Miller & Mosher

[57] ABSTRACT

A word spelling game is disclosed, which teaches the players the consequences and rewards of productive and non-productive conduct in society. The game includes a game board, random number selection means, playing pieces, letter boards, letter pieces and debt cards. A method of playing such a game is also disclosed.

2 Claims, 2 Drawing Sheets

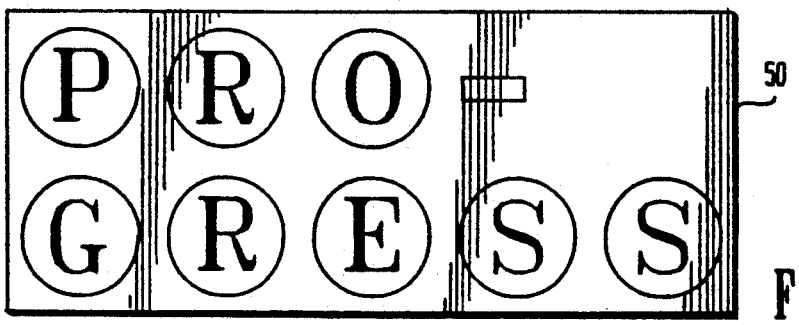
FIG. 2
FIG. 3
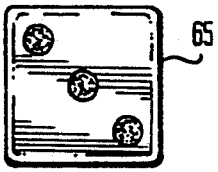
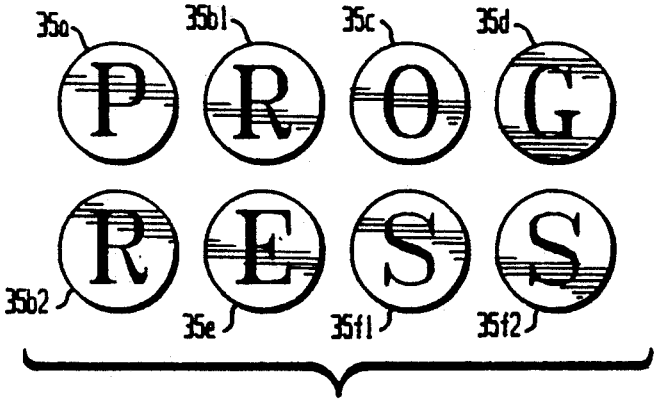
FIG.4
FIG.5
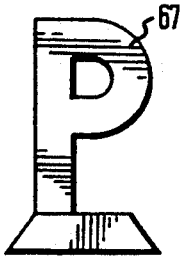
FIG. 6
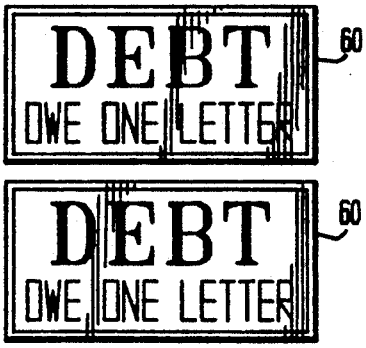

WORD-SPELLING GAME AND METHOD OF PLAYING SUCH A GAME

BACKGROUND OF THE INVENTION

The present invention relates generally to a board game and specifically to a board game in which the object is to be the first player to spell a pre-selected word, such as "PROGRESS".

Although games in which players spell words and/or collect positive attributes are known in the art, none of these games disclose or suggest the present invention.

U.S. Pat. No. 3,759,521, to Breslow et al, relates to a board game including a game board having a plurality of individual tracks, the tracks being "FAITH", "KNOWLEDGE," "HEALTH", "FRIENDSHIP", "MONEY" and "LOVE". The game centers around acquiring "good traits" and losing "bad traits" in each of these six areas. The game comprises a game board as described above, playing pieces, random number selection means, good trait cards and bad trait cards.

U.S. Pat. No. 3,941,388, to Isaac et al, relates to a game and newspaper supplement. The supplement is inserted into a newspaper and has coupons and a game portion. The purpose of this game is to draw the attention of the consumer to the coupons and products advertised thereon.

U.S. Pat. No. 3,984,106, to White, relates to a word-forming game. The game comprises a playing board having a track printed thereon, each playing square in the track having a number or letter printed thereon, playing pieces, dice and cards. In one embodiment, as described in column 3, lines 44 to 50, a word is selected before the game begins and all letters not in that word are removed from the letter card deck. The winner is the player who first spells a word using the letters of the selected word.

U.S. Pat. No. 4,359,226, to Neff, relates to a game embodying the celestial concept of Karma and the repayment in future lives for deeds done in past lives. The game comprises a board having locations along the outer edge thereof, game pieces, dice, Good Karma cards, Bad Karma cards, Good Payback cards and Bad Payback cards. The Good Karma cards cause an immediate disadvantage but a long-term advantage. The Bad Karma cards cause an immediate advantage but a long-term disadvantage. The Good Payback cards cause the exchange of a long-term advantage for an immediate advantage. The Bad Payback cards cause the exchange of a long-term disadvantage for an immediate disadvantage.

U.S. Pat. No. 4,893,819, to Wright, relates to a board game directed to establishing the personality types of the players.

SUMMARY OF THE INVENTION

An object of the present invention is to provide a fun, exciting and comprehensible means through which individuals at a sixth grade reading level or above can obtain a realistic perception of the consequences and rewards commonly associated with productive and non-productive conduct in society.

A second object of the present invention is to provide the player with a clear sense of how crucial productive conduct is in life.

Other objects and advantages of the present invention will become apparent from the disclosure that follows and the accompanying drawings.

One aspect of the present invention relates to a game including a game board, random number selection means, playing pieces, letter boards and pieces for each player, and debt cards. The game board is divided into spaces which are situated continuously around the board and instruct the player as to what action must be taken. The letter boards and pieces contain the letters necessary to spell the pre-selected word to win the game.

A second aspect of the present invention relates to a method of playing a word spelling game as described above. The method comprises:

determining the order of play using the random number selection means;

each player selecting a playing piece and a letter board and letter pieces;

placing the selected playing pieces on the starting point on the game board, and the players sequentially taking turns until one player wins by spelling the pre-selected word. A turn comprises:

determining the number of spaces to move around the playing board using the random number selection means;

moving the appropriate playing piece the corresponding number of spaces; and following the instructions for the space on which the playing piece now rests.

The play of the present invention will be more fully discussed below.

BRIEF DESCRIPTION OF THE DRAWINGS

The present invention will now be described merely by the way of illustration with reference to the accompanying drawings.

FIG. 2 shows a top view of one letter board given to each player for use in playing the game;

FIG. 3 shows one example of a random number selection means which can be employed in the present invention;

FIG. 4 shows letter cards which can be utilized when the preselected word is "PROGRESS";

FIG. 5 shows an example of a playing piece which can be employed in the present invention;

FIG. 6 shows debt cards for use in the present invention.

Figure 1:
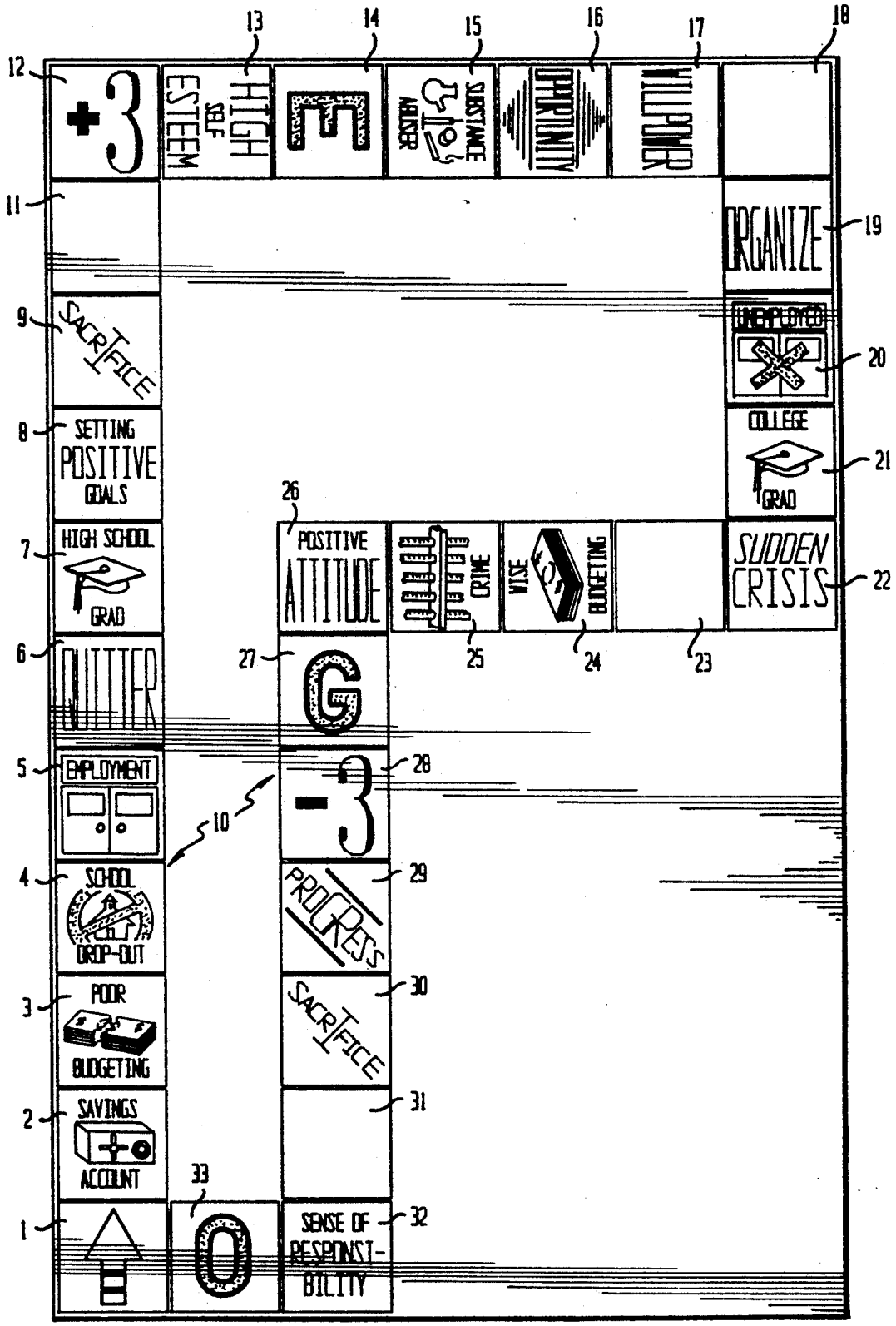
FIG. 1 shows a top view of a playing board of the present invention.

DESCRIPTION OF THE PREFERRED EMBODIMENT AND BEST MODE FOR CARRYING OUT THE PRESENT INVENTION

FIG. 1 illustrates a game board 10 of the present invention which has 32 spaces thereon (spaces 1–9 and 11–33). Space 1 is the starting point. Spaces 11, 18, 23 and 31 are blank and, therefore, act as resting spaces for players landing thereon. The remaining spaces on game board 10 are divided into three categories: those in which a player landing thereon wins one or more letter cards, those in which a player landing thereon loses one or more letter cards, and those in which a player landing thereon must take other action.

There are fifteen spaces on which a player may win letter cards. These spaces are:

| Space No. | Category | Letters won |
|---|---|---|
| 2 | Savings Account | One letter of player's choice |
| 5 | Employment | One letter of player's choice |
| 7 | High School Grad | Three letters of player's choice |
| 13 | High Self Esteem | Two letters of player's choice |
| 14 | E | Letter E |
| 16 | Opportunity | Two letters of player's choice |
| 17 | Willpower | One letter of player's choice |
| 19 | Organize | One letter of player's choice |
| 21 | College Grad. | Three letters of player's choice |
| 24 | Wise Budgeting | Two letters of player's choice |
| 26 | Positive Attitude | Two letters of player's choice |
| 27 | G | Letter G |
| 29 | Progress | Four letters of player's choice |
| 32 | Sense of responsibility | Three letters of player's choice |
| 33 | O | Letter O |

There are six spaces upon which landing results in a player losing letters. These spaces are:

| Space | Category | Letters lost |
|---|---|---|
| 3 | Poor Budgeting | Two letters |
| 4 | School Drop-out | Three letters |
| 6 | Quitter | Half of those player has |
| 20 | Unemployed | Three Letters |
| 22 | Sudden Crises | Half of those player has |
| 25 | Crime | All |

The remaining spaces on the game board are:

| Space No. | Category | Action Taken |
|---|---|---|
| 8 | Setting Positive Goals | Return all Debt cards |
| 9, 30 | Sacrifice | Distribute evenly among other players half of your letters, beginning with next roller |
| 12 | +3 | Advance three spaces |
| 15 | Substance Abuser | Lose three turns |
| 28 | −3 | Go back three spaces |

When a player wins letters, he/she takes the corresponding letter piece(s), 35*a*–35*f* in FIG. 4, and takes it (them) in a corresponding space(s) on his/her personal letter board 50, as shown in FIG. 2. Since the word "PROGRESS" contains two each of R and S, each player has two letter pieces, 35*b*1 and 35*b*2, and 35*f*1 and 35*f*2, corresponding to each of these letters. When a player loses letters, the corresponding letter piece(s) 35*a*–35*f* are removed from the player's letter board 50. In this manner, players can monitor both their own progress and that of the other players.

As play proceeds, there may be instances in which a player loses letters he/she does not have. When a player loses more letters than he/she has, one Debt card is taken for each letter greater than those the player has. For example, a player loses six letters but has only three letter pieces 35*a*–35*f*. The player removes the three letter pieces 35*a*–35*f* from his/her letter board 50 and then takes three Debt cards 60, as shown in FIG. 6, to make up the difference. The Debt cards 60 are returned as letters are won until the player has no Debt cards 60 left. Then, the player can begin to again accumulate letter cards 35*a*–35*f*.

The game is played according to the following method:

Prior to beginning play, the order in which the players proceed is determined using a random number selection means, such as a die 65, as shown in FIG. 3. Each player also selects a playing piece 67, as shown in FIG. 5, for use in the game. The playing pieces 67 can differ from each other in any acceptable manner, such as shape, size or color. Each player also takes a letter board 50 and letter pieces 35*a*–35*f*, as discussed above. All of the playing pieces 67 are placed on game board 10 at the starting point, space 1. Then play begins.

The first player uses the random number selection means 65 to determine how many spaces to move around the game board 10. The player then moves his/her game piece 67 this number of spaces in a clockwise direction around the board. For example, from starting point 1, a roll of three would place the player on School Drop-out, 4. The player then follows the instructions, as described above, for the space on which his/her game piece 67 rests, if necessary taking Debt cards 60 to satisfy any deficit in letter pieces 35*a*–35*f*. Play then proceeds to the next player and continues until one player spells "PROGRESS" with letter pieces 35*a*–35*f* on his/her letter board 50. The first player to spell "PROGRESS" wins.

Although the preferred embodiment is directed to a game spelling the word "PROGRESS", applicant intends as his invention games in which a different word is spelled. In such a case, letter pieces and letter boards directed to the word to be spelled are provided. Spaces 14 (E), 27 (G) and 33 (O) on the game board 10 then represent a win of a different letter piece, if necessary, as decided by the players before the game begins. Alternatively, these spaces can act as blanks or result in the loss of letters when a different preselected word is used.

What I claim is:

1. A method of playing a word-spelling game comprising:

providing each player with a game piece, a letter board having spaces for each letter in a pre-selected word and a plurality of letter pieces corresponding to the letters in the pre-selected word and to the spaces on the letter board;

providing a game board, Debt cards and means for random number selection;

placing the game pieces on a starting point of the game board having individual spaces arranged in a continuous path thereon;

determining which player plays first;

proceeding successively from said first player to a last player, each player taking a turn; and repeating the taking of turns from the first player to the last player until one player successfully spells the pre-selected word with the player's plurality of letter pieces on the player's letter board, thereby winning the game;

a turn comprising:

determining how many spaces to move around the game board using the random number selection means;

moving the appropriate game piece the determined number of spaces in a clockwise direction around the game board; and taking appropriate action based on the space on which the game piece rests;

said appropriate action comprising:

winning letter pieces when the game piece rests on a space referring to productive conduct;

losing letter pieces when the game piece rests on a space referring to non-productive conduct and the player has a sufficient number of letter pieces to do so, or, depending on whether the player has any letter pieces;

taking Debt cards with printed matter thereon which indicate letter pieces lost by the player by landing on spaces referring to non-productive conduct and indicating the loss of letter pieces that the player has not yet won.

2. The method of claim 1, wherein the pre-selected word is "PROGRESS".

* * * * *